United States Patent [19]

Michaelis

[11] 4,176,707

[45] Dec. 4, 1979

[54] METHOD OF CONTINUOUSLY CASTING A STEEL STRAND

[75] Inventor: Eduard Michaelis, Seewalchen, Austria

[73] Assignee: Vereinigte Österreichische Eisen- und Stahlwerke - Alpine Montan Aktiengesellschaft, Linz, Austria

[21] Appl. No.: 823,669

[22] Filed: Aug. 11, 1977

[30] Foreign Application Priority Data

Aug. 20, 1976 [AT] Austria ..... 6184/76

[51] Int. Cl.[2] ..... B22D 11/00

[52] U.S. Cl. ..... 164/89; 164/440; 164/444

[58] Field of Search ..... 164/49, 50, 51, 82, 164/83, 89, 147, 250, 251, 440, 444, 418, 338 R, 425, 426

[56] References Cited

U.S. PATENT DOCUMENTS

| | | | |
|---|---|---|---|
| 3,263,283 | 8/1966 | Allard | 164/440 X |
| 3,587,718 | 6/1971 | Hopkins | 164/440 |
| 3,763,921 | 10/1973 | Behr et al. | 164/89 |
| 3,814,166 | 6/1974 | Watts | 164/440 X |

*Primary Examiner*—Robert L. Spicer

*Attorney, Agent, or Firm*—Brumbaugh, Graves, Donohue & Raymond

[57] ABSTRACT

In a method of and apparatus for continuously casting a steel strand with a mould having a closed bottom molten steel is cast from a casting container into the mould, and the mould is moved away in a substantially horizontal direction to form a strand with a solidified skin and a liquid core, which strand is longer than the mould. Then the strand outside the mould is supplied with heat to maintain a uniform temperature of the liquid core, which temperature is higher than the liquidus temperature of the steel over most of the longitudinal extension of the strand.

8 Claims, 4 Drawing Figures

METHOD OF CONTINUOUSLY CASTING A STEEL STRAND

BACKGROUND OF THE INVENTION

The invention relates to apparatus and a method of continuously casting a steel strand having a length exceeding the length of a mould having a closed bottom. Into mould molten steel is introduced from a casting container or a tundish, and during the casting procedure the mould is moved away from the casting container or tundish along a substantially horizontal path so as to form a steel strand having a solidified strand skin and a liquid core. Further molden steel is poured from the casting container or tundish through the solidified strand skin in the direction to the mould bottom.

A method of this kind is disclosed in U.S. Pat. No. 3,517,725 and in the publication by H. E. Allen, L. Watts and R. Hadden, "Horizontal Continuous Casting in a Closed-End Mold System, The Watts Process", Continuous Casting, Biarritz, France, May 30th to June 2nd, 1976 (publication of lectures at a Continuous Casting Convention).

The disadvantage of the known method consists in that the longer the casting is continued, the smaller the channel for the supply of steel from the tundish to the continuous casting mould becomes, i.e. the diameter of the liquid core reduces over the entire length of the strand. Thereby the length of the strands is limited. It is a further disadvantage that the temperature sinks so low as a consequence of the heat emission from the strand surface to the environment by radiation or cooling, respectively, that it is below the liquidus temperature of the steel over a substantial part of the longitudinal extension. This condition arises at a short distance behind the outflow opening of the tundish. From this point to the bottom of the mould there is created a zone with a 2-phase mixture comprised of liquid melt and solidified crystals, which, when the procedure has been finished, is caused to solidify. The presence of this 2-phase-mixture over such a great length of the strand is a grave disadvantage since the mixture solid/liquid gradually becomes more semiliquid and the uniform supply of steel to the bottom of the mould is not safeguarded. Also, the uniform solidification and homogeneity of the cast strand is not safeguearded with this known method of operation.

SUMMARY OF THE INVENTION

It is the object of this invention to improve this known method in such a way that it is not only possible to produce longer strands operationally safely, but also to obtain a qualitative improvement. In particular it is the object of the invention to create better conditions for the supply of molten steel to the mould and for the solidification of the steel.

Thus the invention in the method of the above-defined type comprises supplying the strand part outside the mould with heat such that the temperature of the liquid core of the strand is uniform and is above the liquidus temperature of the steel over most of the region of the longitudinal extension of the strand.

A particularly advantageous manner of carrying out the invention is characterized in that the temperature of the liquid core of the strand remains substantially constant between a first cooling zone at the beginning of the strand and a second cooling zone in front of the mould and that only in the region of the mould is it decreased to or below the liquidus temperature.

For improving the quality of the strand, i.e. for a better mixing of the strand core which also effects a temperature equalization transversely and longitudinally of the strand, according to the invention it is suggested to administer a stirring movement to the liquid core of the strand simultaneously with the supply of heat.

However, the method can also be applied in such a manner that the stirring movement of the liquid strand core occurs only in the second cooling zone arranged in front of the mould.

A further way of doing this stirring movement of the liquid strand core until the end of casting is effected substantially within the second cooling zone arranged in front of the mould, while in the remaining regions of the strand the stirring movement is only effected during the solidification of the liquid core of the strand.

The invention also relates to an apparatus for carrying out this method with a mould having a closed bottom and movable in a substantially horizontal direction from a container containing molten steel and having an outflow opening. This apparatus is characterized by the arrangement of a plurality of heating means capable of enveloping the strand skin, which means are preferably designed as electrical heating means. The heating means are combined with an electro-magnetic stirring means and are successively movable into and out of the operation position in the course of the movement of the mould or the formation of the steel strand.

Suitably, an electromagnetic stirring means is provided in front of the mould and is displaceable together with the mould.

A further development of the invention comprises bores in the electromagnetic stirring means adjacent the mould for introducing spraying nozzles for cooling the strand.

Furthermore, it is advantageous that the heating and stirring means, respectively, are provided with supporting means engaging the lower side of the strand skin.

A possible and advantageous embodiment comprises heating means having a C or U-shaped cross-section, and being adjustable to a closure piece movable into and out of the operating position, which closure piece is designed as heat-insulating plate.

BRIEF DESCRIPTION OF THE DRAWINGS

The invention shall now be described by way of example only and with reference to the accompanying drawings, wherein.

DESCRIPTION OF ILLUSTRATIVE EMBODIMENTS

Figure 1:
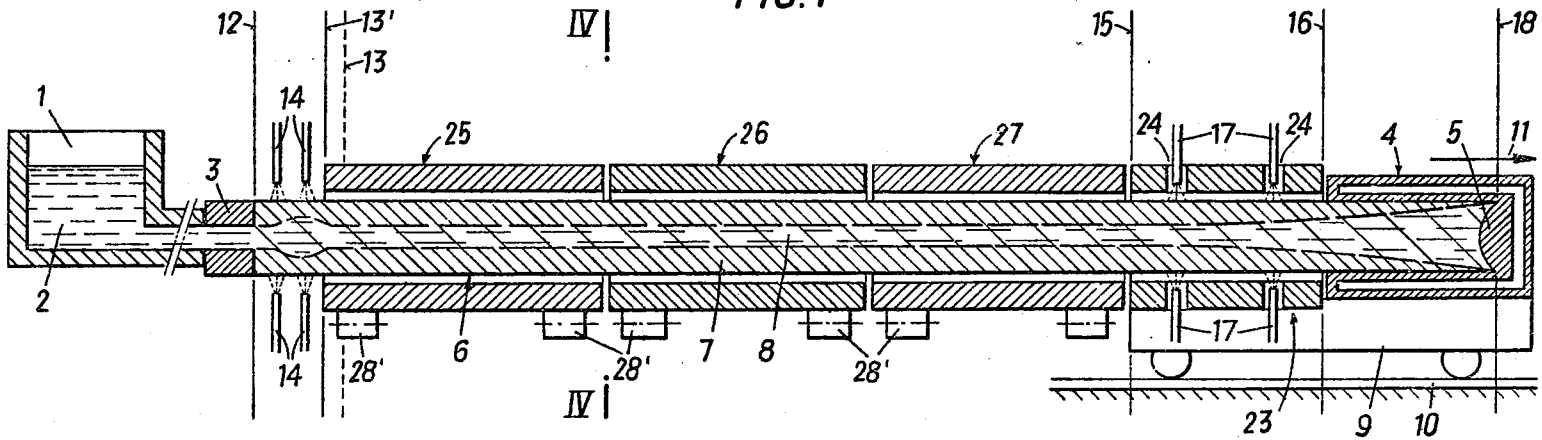
FIG. 1 is a simplified schematic illustration of a vertical section through a horizontal-type continuous casting plant according to the invention.

In FIG. 1, a tundish is denoted by 1, from which tundish molten steel 2 flows through a nozzle and a hollow starter piece 3 into a water-cooled mould 4. This mould 4 has a closed bottom 5 and, at the onset of casting, it overlaps the starter piece 3. It carries out an oscillating movement in the horizontal direction and is moved away from the tundish 1, thus forming a strand 6 which strand has a solidified skin 7 and a liquid core 8. For moving it the mould 4 is mounted on a car 9, which is continuously displaced along a rail path 10 in the direction of the arrow 11. Delimiting lines of a cooling zone are denoted by 12 and 13, in which cooling zone spraying nozzles 14 are provided; the delimiting line 13 is indicated in broken lines. According to the prior art process, line 13 is approximately where the cooling zone ends, which zone directly follows the starter piece 3 and prevents the occurrence of too strong an erosion of the strand skin, caused by the continuously flowing steel, or a break-through of the strand skin 7. The delimitation of the cooling zone when applying the process of the invention is denoted by 13'. According to the invention, it is attempted to reduce the cooling effect in this zone in such a manner that the temperature decrease remains slight; the temperature of the liquid core 8 is to be as near the temperature in the tundish 1 as possible, which temperature in the tundish is at a distance above the liquidus temperature of the steel 2.

A further delimitation line is denoted by 15. In the prior art method in the zone between the lines 13 and 15 heat had been conducted away by radiation and the temperature of the liquid core 8 had decreased. According to the present invention however, heating and stirring means 25, 26, 27 are provided within the zone delimited by the lines 13' and 15, which means are to be described in detail later on.

Immediately in front of the mould 4 there is a second cooling zone which is indicated by the delimiting lines 15 and 16 and formed by the spraying nozzles 17. Despite the cooling effect of the second cooling zone and mould 4, the liquid core 8 is enlarged in this area as is shown in the drawing, wherein the delimiting line 18 indicates the end of the strand. The strand is liquid at the bottom 5 of the mould because the bottom directly receives the liquid core which it cools to form the strand skin that thickens towards the open end of the mould and in the secondary cooling zone.

Figure 2:
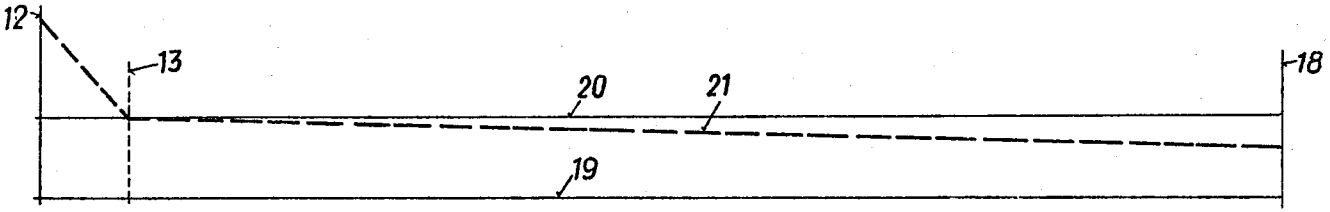
FIG. 2 shows the course of the temperature in the liquid core of the strand according to the prior art.

From FIG. 2 it can be seen that with the working method hitherto used, the temperature of the liquid core 8 takes its course according to the curve 21. In the first cooling zone indicated by the lines 12 and 13, the temperature falls steeply down to the liquidus temperature 20, and beyond that zone it falls gradually to below the liquidus temperature, so that a temperature between the solidus temperature 19 and the liquidus temperature 20 is present on the bottom 5 of the mould. Consequently, a 2-phase-mixture solid/liquid prevails in the whole region between the lines 13 and 18, which is very disadvantageous since the movement of the steel is obstructed and the solidification is adversely affected.

Figure 3:
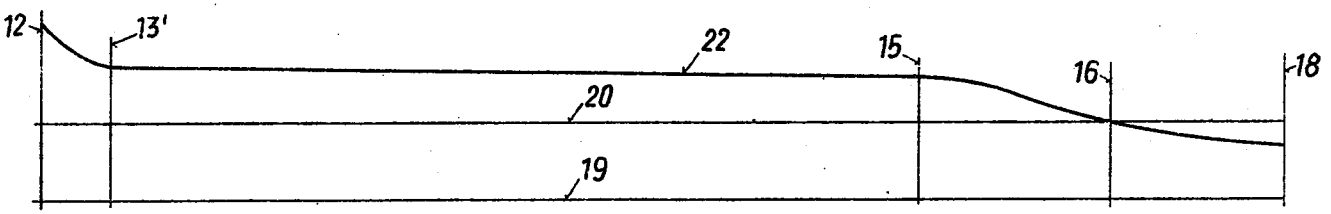
FIG. 3 is an illustration similar to FIG. 2, but for the course of the temperature when applying the procedure according to the present invention.

FIG. 3 shows the course according to a preferred embodiment of the invention. In the shorter first cooling zone indicated by the lines 12, 13', the temperature decrease is relatively slight; in the zone following thereupon, the temperature remains quite constant, as is shown by the course of the temperature curve 22, and it is far above the liquidus temperature so that the premature formation of mixed crystals or dentrites is reliably avoided. Only in the second cooling zone between lines 15 and 16 does the temperature decrease to the liquidus temperature 20. As a result the formation of a 2-phase mixture is limited to approximately the cooling region indicated by the lines 16 and 18 in the mould 4. Thus, according to the invention, in front of this mould region an electromagnetic stirring means is arranged, whose function and effect on the improvement of the quality of the continuous casting is known per se [see "Die erste elektromagnetische Rühranlage für Strangguss" ("The first electromagnetic stirring plant for continuous casting") by IRSID and CEM as well as publication by Robert Alberny, Lazlo Backer, Jean-Pierre Birat, Paul Gosselin, and Maurice Wanin "Quality Improvement of Strand-cast Billets Through Electromagnetic Stirring", Electric Furnace Proceedings, 1973, pages 237 to 245]. In the drawings this apparatus is illustrated only schematically and is denoted by 23 as a whole. It is provided with bores 24 for the arrangement of spray or jet nozzles 17 for cooling the strand 6, the lower openings serve for draining the water. Heating means are denoted by 25, 26 and 27, which heating means can be designed in different ways. In particular the heat supply can be effected electrically by radiation, but also by oil or gas heating by radiation and convection. It is preferred to use a combined electric and electromagnetic heating and stirring means. It has the effect that the strand skin is maintained at a uniform temperature, so that the temperature of the liquid core 8 approximately follows the curve 22 of FIG. 3. The heat given off by the parts 25, 26 and 27, is regulated by temperature measuring equipment and/or measuring equipment for the thickness of the strand skin (not shown). Simultaneously, or when the casting has been finished, a stirring movement is effected in the liquid core 8, as has been known per se and as has been disclosed in detail in the publications mentioned; therefore, it is not necessary to discuss the construction details of these means which belong to the prior art and have frequently been used in the field of continuous casting.

Figure 4:
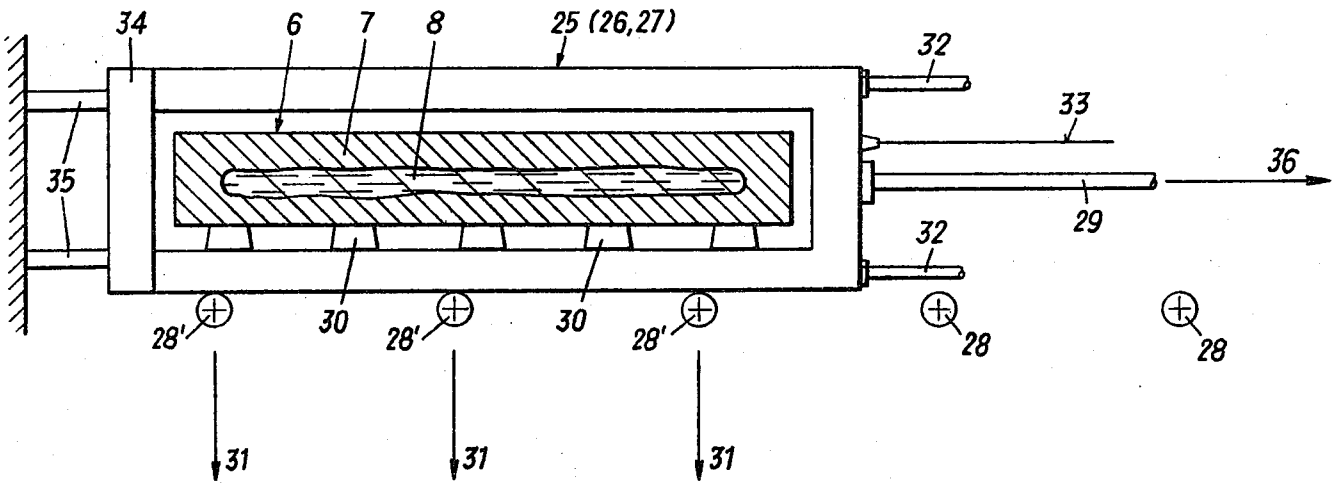
FIG. 4 is a vertical section along line IV—IV of FIG. 1 on an enlarged scale.

From FIG. 4 one of a number of possibilities for adjusting the heating and stirring means 25, 26 and 27 to the strand 6 without changing its position, can be seen.

For each one of these means 25, 26 and 27, a roller path 28 is laterally provided which corresponds with a further roller path 28' in the region of the strand 6. The roller path 28' is adjustable to the means 25, 26 and 27 by lifting or pivot means not illustrated, or a displacement means 29 displaces each of the means 25, 26 and 27 one after the other on the roller path 28', support means 30 serving for supporting the strand 6. When the casting has been completed, the roller path 28' is lowered in the direction of the arrows 31. The heating and stirring means 25, 26 and 27, which are provided with cooling water connections 32 for the electromagnetic stirring means and a current supply conduit 33, have a C or U-shaped cross-section, particularly when casting slabs, and they are adjustable to a heat-insulating wall 34 so that a closed space is formed. The wall 34 is mounted on a holding means 35 so as to be horizontally displaceable. When the casting has been finished, the means 25, 26 and 27 are removed in the direction of the arrow 36, the strand is divided into a number of parts in a usual manner and further processed. Of course, the means 25, 26 and 27 can also have a different cross-section and be designed in a number of parts. The adjustment to the strand 6, too, can be effected by different means, the means can, for instance, be horizontally displaced by rollers on double-T-carriers arranged above the strand 6 and transversely to the direction of movement 11 of the mould.

The stirring means 23 also is provided with supporting means 30 for the strand 6. Other than the heating means 25, 26 and 27, it is closed all around; thus it has a cross-section adapted to the strand profile. The stirring means 23 is mounted on the car 9 and is already in an operating position when the continuous casting machine is put in operation. If it is advantageous, it can also reciprocate together with the mould 4 in the direction of movement 11.

Due to the heat supply, the diameter of the liquid core 8 can be kept wider than has hitherto been possible, and strands of unlimited length and of the best quality can be produced, insofar as a correspondingly great number of means 25, 26 and 27 is available. These heater and stirring means are designed alike, i.e. they form a modular construction system, which lowers the investment and operating costs.

What I claim is:

1. In a method of continuously casting a steel strand by using a mould having a closed bottom, the cast strand having a longitudinal extension exceeding that of the mould, said method including the steps of introducing molten steel from a casting container into said mould, moving said mould away from said casting container along a substantially horizontal path for forming the steel strand with a solidified strand skin and a liquid core, and pouring further molten steel through said solidified strand skin in the direction toward the bottom of the mould, the improvement comprising the step of supplying heat to at least a portion of the strand located outside of said mould between the mould and the casting container so as to cause the liquid core in that portion of said strand to have a uniform temperature, said heat being sufficient to keep said core temperature above the liquidus temperature of the steel over most of the longitudinal extension of the cast strand.

2. A method as set forth in claim 1, wherein the casting container is a tundish.

3. A method as set forth in claim 1, further comprising the steps of establishing a first cooling zone where the strand begins and a second cooling zone in front of the mould, maintaining the temperature of the liquid core of the strand substantially constant between said first and second cooling zone, and causing the temperature of the liquid core to decrease in the region of the mould.

4. A method as set forth in claim 3, wherein the temperature of the liquid core is caused to decrease to the liquidus temperature in the region of the mould.

5. A method as set forth in claim 3, wherein the temperature of the liquid core is caused to decrease to below the liquidus temperature in the region of the mould.

6. A method as set forth in claim 1, further comprising the step of stirring the liquid core of the strand simultaneously with the step of supplying heat.

7. A method as set forth in claim 6, further comprising the step of establishing a first cooling zone where the strand begins and a second cooling zone in front of the mould, and wherein the liquid core of the strand is stirred only in said second cooling zone.

8. A method as set forth in claim 6, further comprising the step of establishing a first cooling zone where the strand begins and a second cooling zone in front of the mould, and wherein the liquid core of the strand is stirred substantially within said second cooling zone until the casting has been finished and said strand has solidified in said second cooling zone, and the liquid core in the remaining portion of the strand is stirred only after the casting has finished and while it is solidifying.

* * * * *